United States Patent [19]

Stellrecht

[11] Patent Number: 5,020,225

[45] Date of Patent: Jun. 4, 1991

[54] SPLITTING TOOL

[76] Inventor: Ewald A. Stellrecht, 407 Spackman La., Exton, Pa. 19341

[21] Appl. No.: 562,775

[22] Filed: Aug. 3, 1990

[51] Int. Cl.[5] ..... B26B 23/00

[52] U.S. Cl. ..... 30/308.1; 144/193 C; 254/104

[58] Field of Search ..... 30/308.1; 144/193 C, 144/193 D, 143 R; 254/104

[56] References Cited

U.S. PATENT DOCUMENTS

| | | | |
|---|---|---|---|
| 443,581 | 12/1890 | Marshall | 144/193 D |
| 3,865,163 | 2/1975 | Root | 254/104 |
| 4,044,808 | 8/1977 | Kolonia | 145/2 R |
| 4,372,360 | 2/1983 | Eichlin | 145/2 R |
| 4,383,562 | 5/1983 | Hockman | 145/2 R |
| 4,440,205 | 4/1984 | Hillinger | 145/2 R |

FOREIGN PATENT DOCUMENTS

| | | | |
|---|---|---|---|
| 443758 | 3/1975 | U.S.S.R. | 144/193 D |

*Primary Examiner*—W. Donald Bray

*Attorney, Agent, or Firm*—Seidel, Gonda, Lavorgna & Monaco

[57] ABSTRACT

A splitting tool comprising a splitting head mounted on a handle. The splitting head comprises at least two relatively rotatable wedges, at least one of which is also freely rotatable with respect to the handle. Each wedge has a front edge for striking and penetrating an object to be split. The freely rotatable wedge has a lobe rearward of the front edge and a center of mass located in the lobe, the center of mass being offset from the axis of rotation of the freely rotatable wedge. The offset center of mass creates a force moment about the axis of rotation. The force moment has a first rotational sense tending to align the front edges of each wedge along a common plane when the splitting head is impelled toward the object and a second and opposite rotational sense tending to separate the front edges of each wedge when the splitting head strikes the object, thereby applying splitting forces to the object in directions generally perpendicular to the common plane.

8 Claims, 4 Drawing Sheets

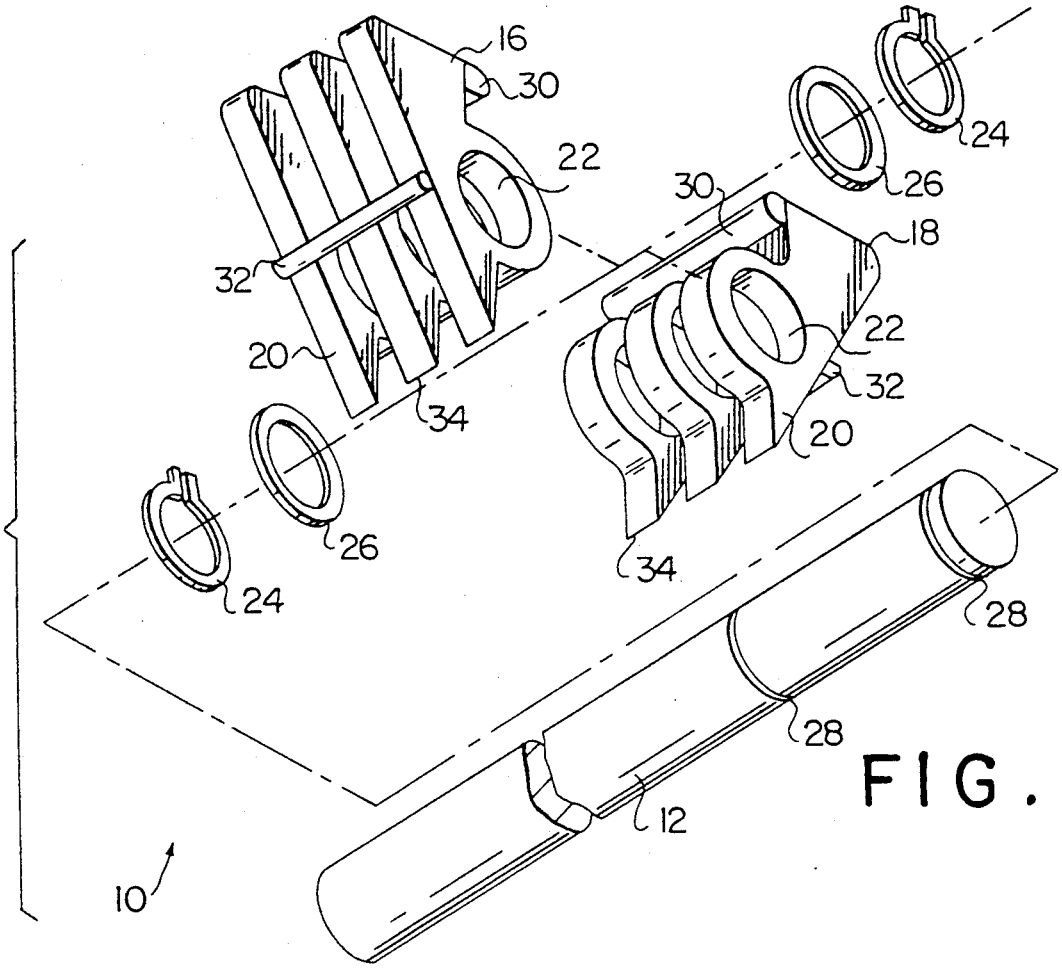
FIG. 3
FIG. 5
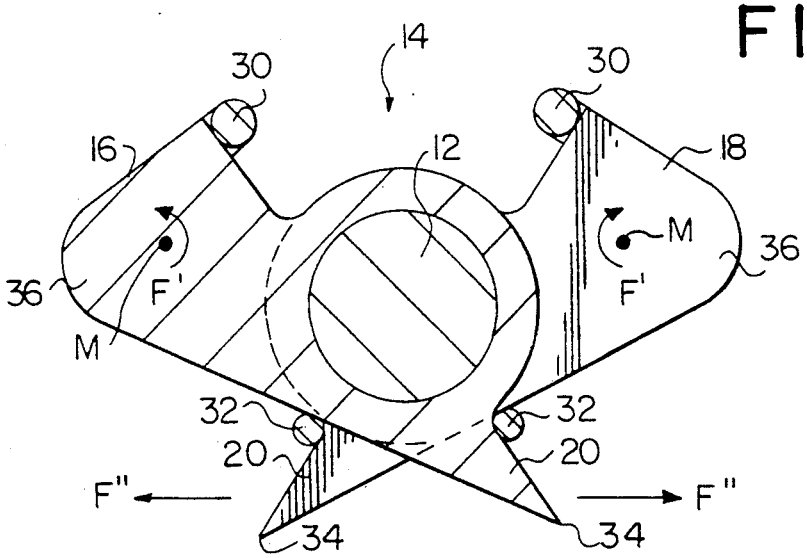

SPLITTING TOOL

FIELD OF THE INVENTION

The present invention relates to splitting tools, in particular splitting tools used for splitting objects such as, but not necessarily limited to, wood.

BACKGROUND OF THE INVENTION

Splitting wood for various purposes is old. Over the years, many different devices for splitting wood have been developed, These devices generally use some sort of means for spreading apart the wood after it has been struck by a cutting edge. Some of the prior art splitting tools are simply wedges in which the sharp end is driven into the wood by striking it with a maul. Others are much more complicated and utilize various arrangements of levers or arms which spread apart the wood. Examples of this latter type of design may be found in U.S. Pat. Nos. 4,044,808, 4,372,360, 4,383,562 and 4,440,205.

U.S. Pat. No. 4,044,808 discloses a splitting tool with a cutting edge flanked by a pair of pivoting spreaders located slightly rearward of the cutting edge. As the cutting edge enters the wood, end surfaces of the spreaders enter the crack formed by the cutting edge and tend to force the two pieces of the wood apart. The wood is split through the initial thrust of the cutting edge followed by contact of the spreaders and the wood.

U.S. Pat. No. 4,372,360 is very similar to U.S. Pat. No. 4,044,808, in that it also discloses a splitting tool with a cutting edge flanked by a pair of pivotable spreaders. In addition, the tool in U.S. Pat No. 4,372,360 includes a compression spring which transmits striking force to the spreaders, causing the spreaders to enter the wood and force the two pieces apart by a combination of contact with the wood and an applied force from the compression spring.

U.S. Pat. No. 4,383,562 discloses a variation on the scheme of flanking spreaders. In this patent, the splitting tool has a cutting edge made up in part of two spreaders which, unlike the earlier patents, have an edge which enters the wood simultaneously with a non-pivotable cutting edge. The spreaders have obliquely-extending "thrust levers" which contact the wood after the cutting edge has entered it and force the spreaders to pivot and, in turn, force apart the wood.

U.S. Pat. No. 4,440,205 discloses a splitting tool which more or less combines the features of the prior patents. Thus, the splitting tool disclosed in this patent uses both spreaders that are forced apart by impact and which have thrust levers to force them apart.

The splitting tools disclosed in all of these patents, however, require substantial penetration of the wood by a cutting edge before the spreaders can operate to force the pieces of wood apart, and therein lies the problem. The tool needs to be swung against the wood with a great deal of force, or the cutting edge will not penetrate far enough for the spreaders to be effective. This can become very tiring to the person splitting the wood, since the benefit of the spreaders is not obtained except at great effort, thus reducing the advantages of having spreaders in the first place. In addition, unless the tool is swung against the wood hard enough for the spreaders to work, the cutting edge can bind in the wood, making splitting a difficult, tiring and time-consuming task.

One attempt at avoiding the problems with the prior tools is exemplified by U.S. Pat. No. 4,381,809. That patent discloses a splitting ax with a clamshell-type head which pivots open upon impact with the wood under the force of a movable wedge within the head. The halves of the head are spring-biased to automatically close when the ax is removed from the wood. The tool of that patent, however, also has to be swung against the wood with a great deal of force, or the wedge will not have enough impact momentum to force open the halves of the head. In addition, the tool is subject to binding because the wedge tends to keep the halves of the head in tight frictional contact with the wood on either side of the head. The wedge cannot be easily retracted to allow the head to close in order to eliminate binding.

There is a need for a simple, effective splitting tool that is effective without requiring a great deal of impact force to achieve splitting, is easy to use, simple to manufacture, and avoids the drawbacks of prior splitting tools. The present invention fulfills that need.

SUMMARY OF THE INVENTION

The present invention is directed to a splitting tool comprising a splitting head mounted on handle means. The splitting head comprises at lest two relatively rotatable wedge means, at least one of which is also freely rotatable with respect to the handle means. Each wedge has a front edge for striking and penetrating an object to be split. The freely rotatable wedge means has a lobe rearward of the front edge and a center of mass located in the lobe, the center of mass being offset from the axis of rotation of the freely rotatable wedge means. The offset center of mass creates a force moment about the axis of rotation. The force moment has a first rotational sense tending to align the front edges of each wedge means along a common plane when the splitting head is impelled toward the object and a second and opposite rotational sense tending to separate the front edges of each wedge means when the splitting head strikes the object, thereby applying splitting forces to the object in directions generally perpendicular to the common plane.

DESCRIPTION OF THE DRAWINGS

For the purpose of illustrating the invention, there is shown in the drawings forms which are presently preferred; it being understood, however, that this invention is not limited to the precise arrangements and instrumentalities shown.

FIG. 3 is an exploded view of the tool of FIG. 1.

FIG. 5 is a transverse sectional view of the tool of FIG. 4, taken along the lines 5—5 in FIG. 4.

DESCRIPTION OF THE INVENTION

Figure 1:
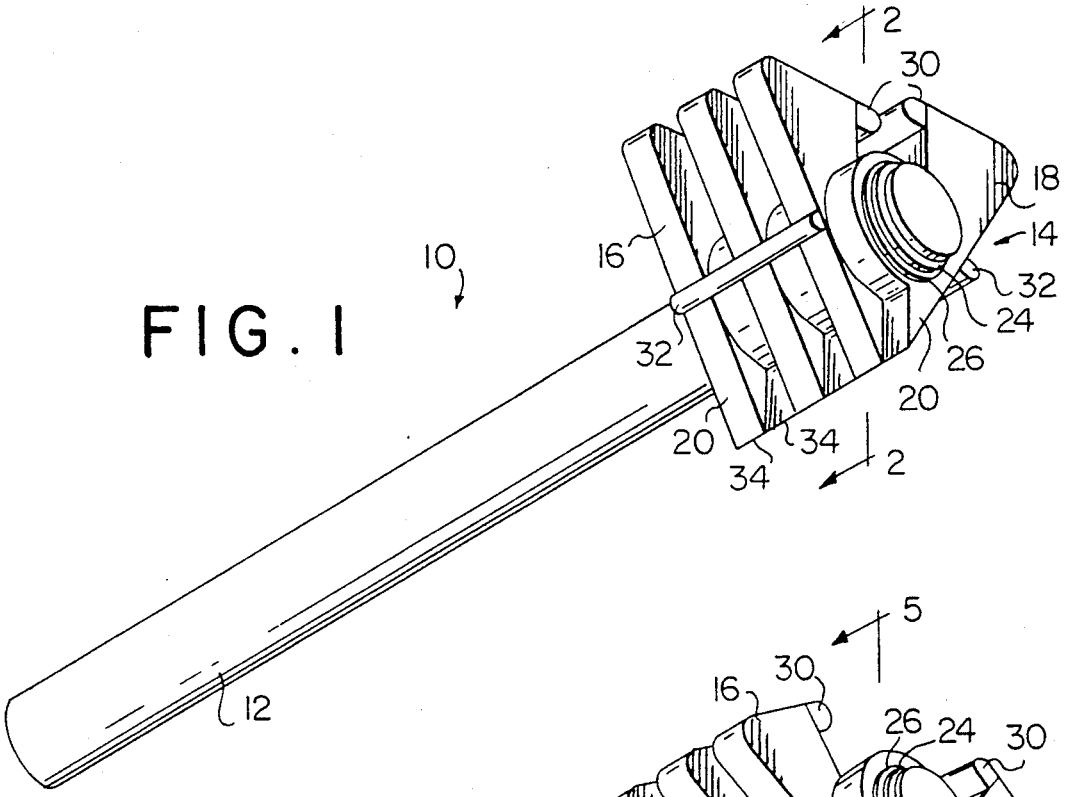
FIG. 1 is an isometric view of a first embodiment of a splitting tool according to the invention, as the wedge means would be aligned as the tool is impelled toward an object to be split.
Figure 4:
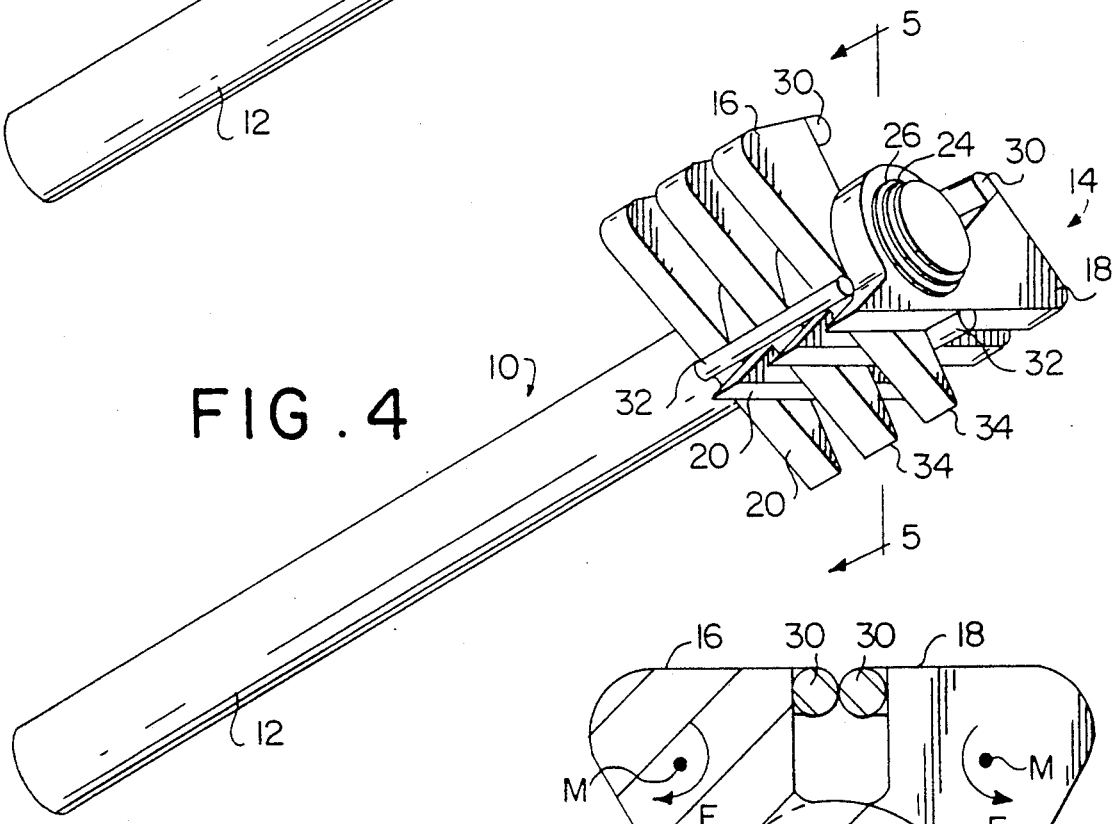
FIG. 4 is an isometric view of the tool of FIG. 1, as the wedge means would be aligned when the tool strikes an object to be split.

Referring now to the drawings, wherein like numerals indicate like elements, there is shown in FIGS. 1 through 5 a splitting tool 10 in accordance with one embodiment of the invention. Splitting tool 10 comprises a handle 12 and a splitting head 14. Handle 12 is generally an elongated cylinder, but need not be exactly cylindrical. Thus, handle 12 may be tapered, or may be contoured much like a traditional ax handle. Handle 12 may be fabricated of any suitable material, such as wood or any of a number of engineering polymers, although wood is preferred since wood is somewhat resilient and naturally absorbs some of the impact that would be transmitted to the arms of the user when swinging the tool against objects to be split. Although the present invention is directed primarily to a hand-held splitting tool, and will be described in that context, it should be understood that the invention is not so limited, and splitting head 14 may be mounted on any other convenient means for impelling head 14 toward an object being split, without departing from the invention. For example, head 14 may be mounted on supports which permit it to be raised and then fall in guillotine-like fashion onto an object placed below head 14.

Splitting head 14 comprises a pair of wedge means 16 and 18 fitted together in interdigitated fashion. Wedge means 16 and 18 are identical and comprise a plurality of individual wedge fingers 20 which are spaced apart by a distance about equal to their width. The wedge fingers 20 of one wedge means are received in the spaces between the wedge fingers of the other wedge means, such that the wedge fingers 20 of both wedge means are interdigitated. Each wedge means 16 and 18 has a generally centrally-located circular bore 22 for mounting on handle 12. The inner diameter of bore 22 is preferably slightly greater than the outer diameter of handle 12 so that each wedge means 16 and 18 is freely rotatable about the central axis of handle 12. Although it is preferred that both wedge means 16 and 18 rotate freely about handle 12, it is not necessary that both do so, and it should be understood that the invention includes a tool 10 in which only one wedge means rotates about the handle while the other remains fixed to the handle. Wedge means 16 and 18 are retained on handle 12 by retaining rings 24 and washers 26 seated in circumferential grooves 28 on handle 12.

Individual wedge fingers 20 are held together and spaced apart by a pair of cross-members 30 and 32. Cross-members 30 and 32 also serve as stops to limit the range of relative rotation of wedge means 16 and 18, as will be described in more detail below. Wedge means 16 and 18 may be conveniently cast in one piece from a suitably hard and durable material, e.g., steel, such that cross-members 30 and 32 are integral with wedge fingers 20. Alternatively, wedge means 16 and 18 may be machined from a block of material, or may comprise individually-fabricated fingers and cross-members suitably joined together such as by welding. It should also be noted that, although three wedge fingers are illustrated in the figures, the exact number of fingers is not crucial to the invention. If desired, as few as one wedge finger 20 on each wedge means may be used.

Each wedge finger terminates at one end in a front edge 34 for striking and penetrating the object to be split by tool 10. Thus, front edge 34 is preferably tapered to a keen cutting edge, much as a conventional ax blade would be tapered. Rearward of front edge 34, each wedge finger 20 widens to a lobe 36. As can be seen in the figures, most of the mass of the wedge fingers 20 is located in lobe 36, and preferably is located rearward of handle 12 (rearward being understood to be in a direction behind front edge 34 as the tool is swung at the object). Hence, each wedge finger 20 will have a center of mass M located in the lobe and offset from the central axis of handle 12. This construction enables wedge means 16 and 18 to rotate freely about handle 12 when the tool is swung at an object to be split, as will now be described.

To split an object, such as a log, the splitting tool 10 is grasped by the handle and swung, in the manner of an ax, at the log. Tool 10 is held so that the front edges 34 of wedge fingers 20 will strike the log and penetrate it. As will be understood, when the tool 10 is swung in this manner it will be raised over the user's head or shoulder and then brought rapidly down on the log. For a brief period, the tool is stationary after it is raised and before it is brought down on the log. As the tool is rapidly brought down against the log, it is accelerated from a rest position. Applying the principles of Newtonian mechanics, the rapid acceleration of the tool will result in a force being applied to all parts of the tool, including the wedge means 16 and 18. Using Newtonian mechanics, the wedge means 16 and 18 can be visualized as point masses located at their respective centers of mass M, and hence the forces on the wedge means 16 and 18 can be visualized as acting on the wedge means 16 and 18 at points M. The direction of this force will be opposite to the direction of movement of the tool; that is, the force will be in a rearward direction. Since wedge means 16 and 18 are mounted for rotation about handle 12, this force will create a force moment about the central axis of handle 12. This force moment is illustrated by the arcuate arrows F in FIG. 2.

Figure 2:
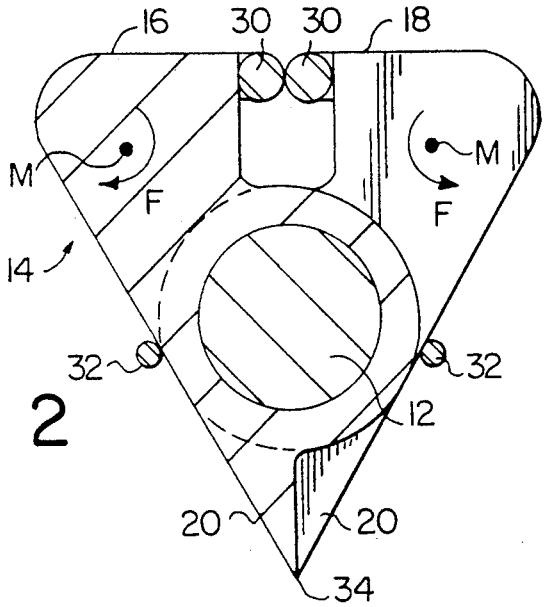
FIG. 2 is a transverse sectional view of the tool of FIG. 1, taken along the lines 2—2 in FIG. 1.

The force moments F shown in FIG. 2 have a clockwise sense with respect to wedge means 18 and a counterclockwise sense with respect to wedge means 16. (The force moments will have opposite senses since the respective centers of mass of wedge means 16 and 18 are on opposite sides of the central axis of handle 12.) The resulting force moment F acting on wedge means 18 thus tends to rotate wedge means 18 in the clockwise direction, and the resulting force moment F acting on wedge means 16 tends to rotate wedge means 16 in the counterclockwise direction. The respective cross-members 30 on wedge means 16 and 18 act as stops to limit the rotation of wedge means 16 and 18 due to the force moments so that the front edges 34 of wedge fingers 20 will be generally aligned in a common plane, as shown in FIGS. 1 and 2. (In FIG. 2, the common plane is perpendicular to the plane of the figure.) This gives tool 10 a substantially continuous cutting edge made up of the front edges 34 of wedge fingers 20.

When the splitting head 14 of tool 10 strikes the log or other object to be split, the cutting edge penetrates the log for a short distance and then head 14 comes to a stop. Again applying the principles of Newtonian mechanics, the rapid deceleration (i.e., acceleration in the opposite direction) of head 14 after striking results in a force on wedge means 16 and 18. This force is directed toward the cutting edge of tool 10, i.e., is directed in the forward direction. Treating wedge means as point masses, as before, it will be seen that the forces on wedge means 16 and 18 resulting from the rapid deceleration of the splitting head 14 results in force moments F' (see FIG. 5) being applied to wedge means 16 and 18. The senses of force moments F' are opposite to the senses of force moments F. That is, the sense of force moment F' acting on wedge means 16 is clockwise, and the sense of force moments F' acting on wedge means 18 is counterclockwise. The respective force moments F' tend to rotate wedge means 16 in a clockwise direction about the axis of handle 12, and tend to rotate wedge means 18 in a counterclockwise direction. Thus, wedge fingers will tend to rotate past each other through their common plane, as shown in FIG. 5. Cross-members 32 act as stops to limit the rotation of wedge means 16 and 18.

The net result is that splitting forces generally perpendicular to the common plane of front edges 34 are applied to the log to be split. That is, as the wedge fingers 20 rotate past each other after the splitting head 14 strikes the log, they apply splitting forces F'' to the log, as shown by the horizontal arrows in FIG. 5. The splitting forces are generally, although not exactly, perpendicular to the common plane, so that virtually all of the energy input to tool 10 in striking the log is available for splitting.

Figure 6:
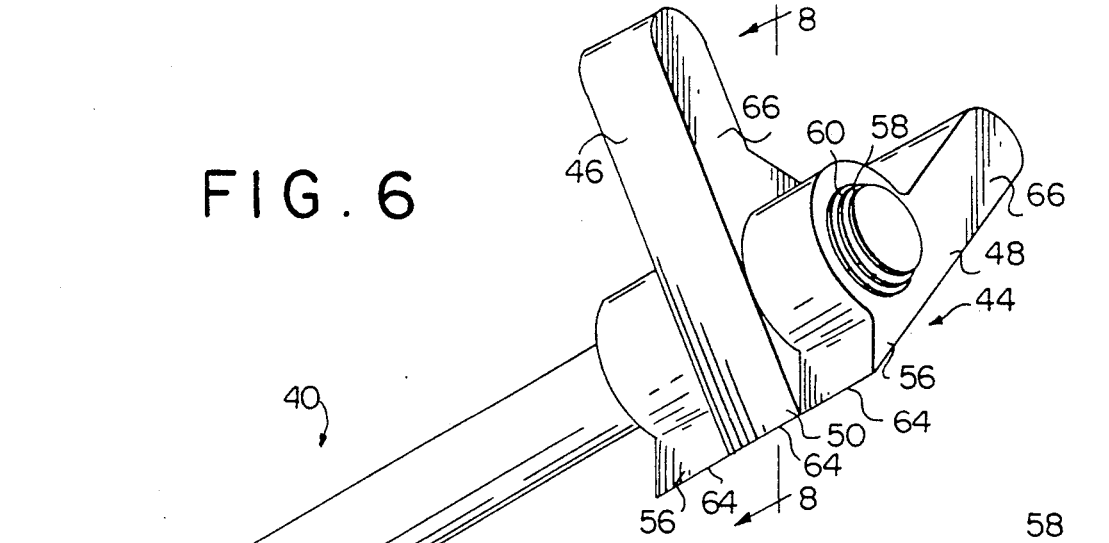
FIG. 6 is an isometric view of a second embodiment of a splitting tool according to the invention, as the wedge means would be aligned when the tool is impelled toward an object to be split.
Figure 7:
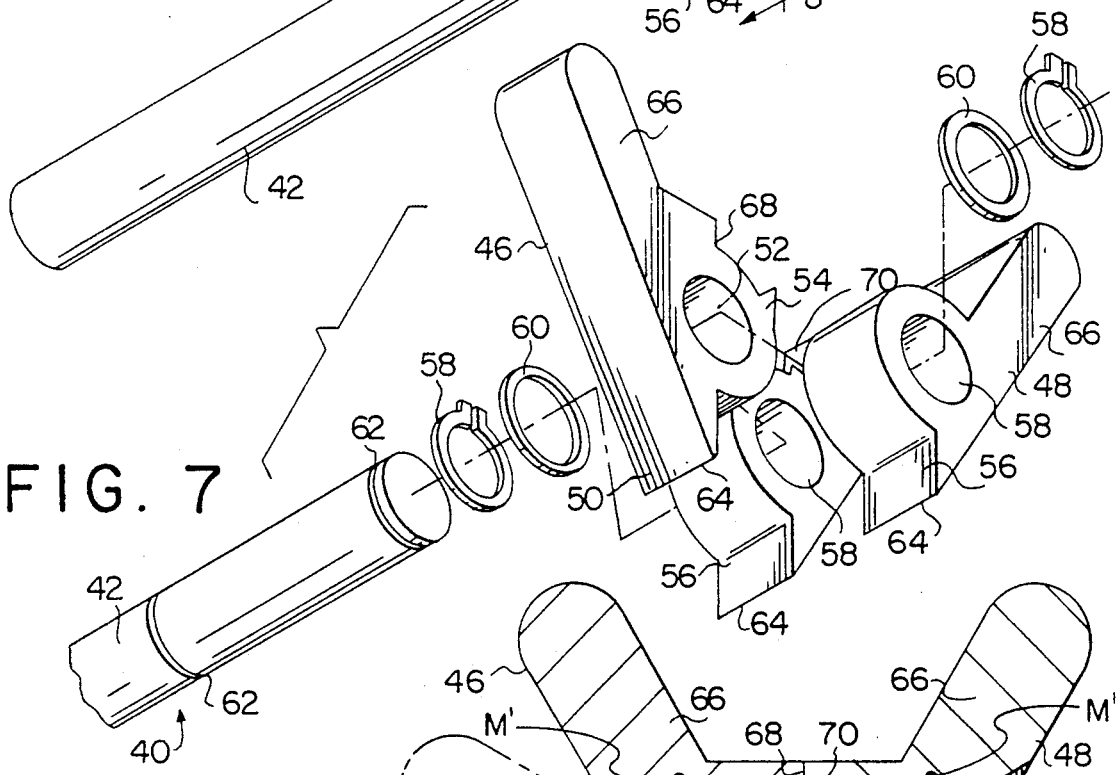
FIG. 7 is an exploded view of the tool of FIG. 6.
Figure 8:
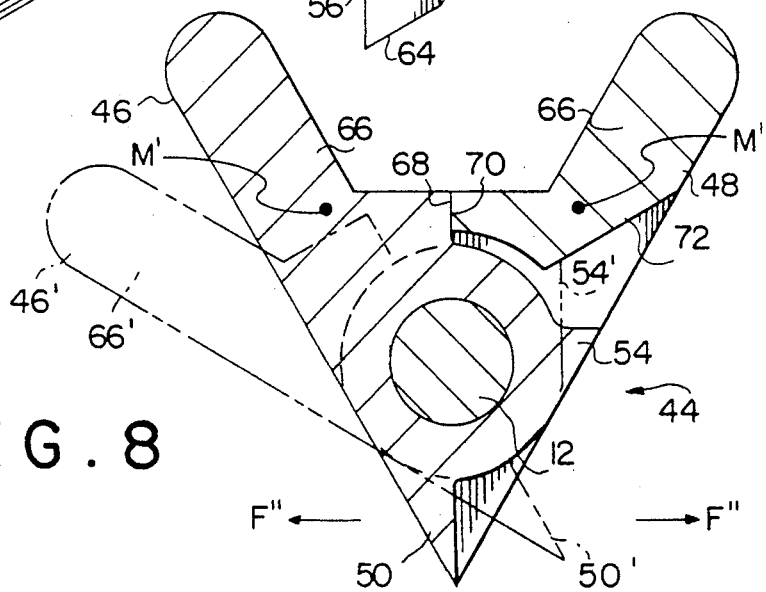
FIG. 8 is a transverse sectional view of the tool of FIG. 6, taken along the lines 8—8 in FIG. 6.

A slightly different form of splitting tool according to the invention is illustrated in FIGS. 6 through 8, and is designated by reference numeral 40. As with the embodiment already described, tool 40 comprises a handle 42 and a splitting head 44. Handle 42 is generally an elongated cylinder, but need not be exactly cylindrical, and may be tapered or contoured like a traditional ax handle. Splitting head 44 comprises a pair of wedge means 46 and 48. Wedge means 46 comprises a wedge finger and a generally centrally-located circular bore 52 for mounting on handle 42. The diameter of bore 52 is preferably slightly greater than the outer diameter of handle 42 so that wedge means 46 is freely rotatable with respect to handle 42. Wedge means 46 includes a pawl 54, which acts as a stop to limit the rotation of wedge means 46, as will be described in more detail below.

Wedge means 48 comprises a pair of individual wedge fingers 56 which are spaced apart by a distance about equal to the width of wedge finger 50, so that wedge means 46 is received within the space and wedge finger 50 will interdigitate with wedge fingers 56. As with wedge means 46, wedge means 48 includes a generally centrally-located circular bore 58, which aligns with bore 52 in wedge means 46, for mounting on handle 42. The inner diameter of bore 58 is preferably the same as that of bore 52, i.e., preferably slightly greater than the outer diameter of handle 42 so that wedge means 48 is freely rotatable with respect to handle 42. As with the previously-described embodiment, only one of wedge means 46 and 48 need rotate, while the other may remain fixed with respect to handle 42. Both wedge means 46 and 48 are retained on handle 42 by retaining rings 58 and washers 60 seated in circumferential grooves 62 on handle 42.

Each wedge finger 50 and 56 terminates at one end in a front edge 64 for striking and penetrating the object to be split by tool 40. Thus, front edge 64 is preferably tapered to a keen cutting edge, much as a conventional ax blade would be tapered. Rearward of front edge 64, each wedge means 46 and 48 includes a lobe 66. In the case of wedge means 48, lobe 66 bridges both wedge fingers 56, so that lobe 66 is a single piece. As can be seen in FIGS. 6 through 8, most of the mass of the wedge means 46 and 48 is located in lobes 66 and is located rearward of handle 42. Hence, each wedge means 46 and 48 will have a center of mass M' located in lobe 66 and offset from the central axis of handle 42, so that the wedge means 46 and 48 may rotate freely about handle 42 when tool 40 is swung at an object to be split.

The same principles of Newtonian mechanics apply to tool 40 as those already discussed in connection with the previously-described embodiment. Thus, when tool 40 is swung at an object to be split, the front edges 64 will align along a common plane to give tool 40 a substantially continuous cutting edge made up of the front edges of wedge fingers 50 and 56. Stop surfaces 68 and 70 on wedge means 46 and 48, respectively, limit the rotation of the wedge means when the tool is swung at the object so that front edges will remain aligned until the splitting head 44 strikes the object. When splitting head 44 of tool 40 strikes the object, wedge means 46 and 48 will rotate relative to each other and to handle 42. Wedge means 46 will rotate in the counterclockwise direction relative to wedge means 48, as shown in FIG. 8. Pawl 54 on wedge means 46 limits the rotation of wedge means 46 relative to wedge means 48 by engaging stop surface 72 on wedge means 48, so that wedge means 46 will not rotate past the position shown in phantom in FIG. 8.

As with the previously-described embodiment, after splitting head 44 strikes the object, wedge fingers will tend to rotate past each other through their common plane until pawl 54 engages stop surface 72. The net result is that splitting forces generally perpendicular to the common plane of front edges 64 are applied to the log to be split. That is, as the wedge fingers 50 and 56 rotate past each other after the splitting head 44 strikes the object, they apply splitting forces F'' to the object, as shown by the horizontal arrows in FIG. 8. The splitting forces are generally, although not exactly, perpendicular to the common plane so that substantially all of the energy with which tool 40 is swung goes to splitting the object.

Figure 9:
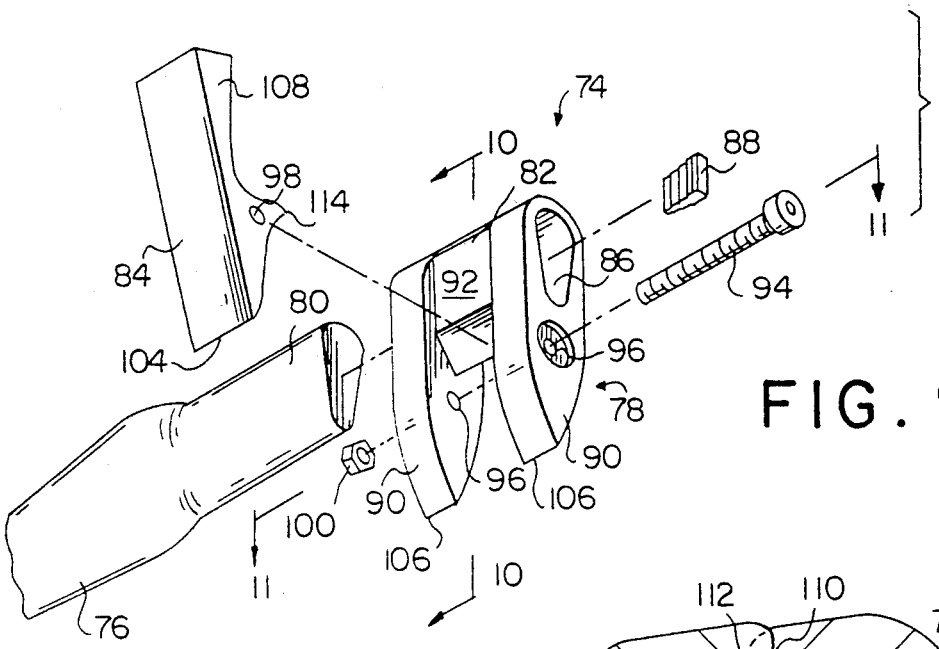
FIG. 9 is an exploded view of a third embodiment of a splitting tool according to the invention.
Figure 10:
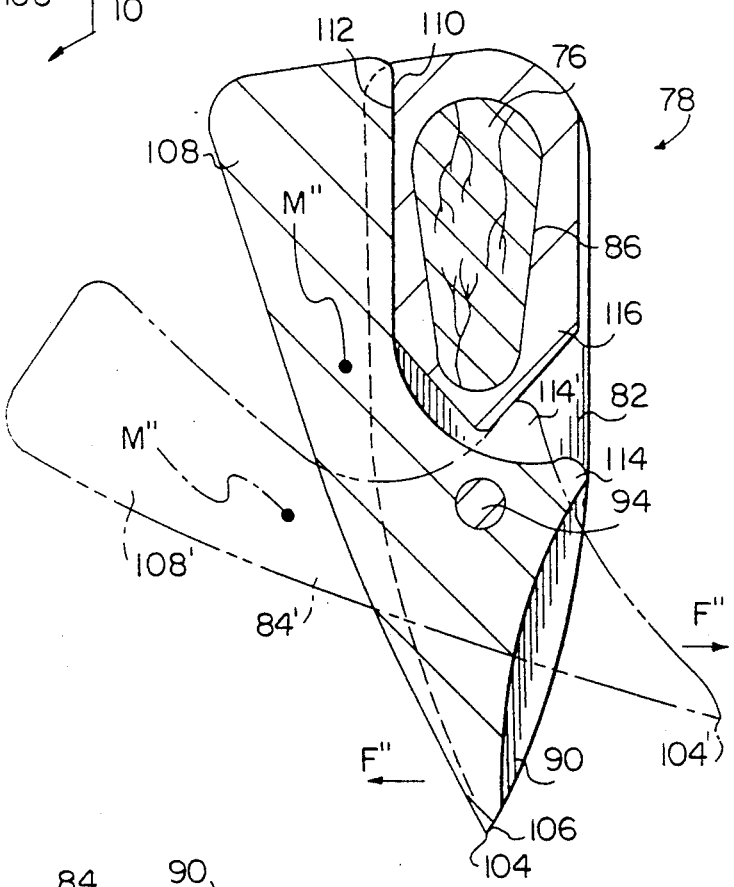
FIG. 10 is a transverse sectional view of the tool of FIG. 9, taken along the lines 10—10 in FIG. 9.
Figure 11:
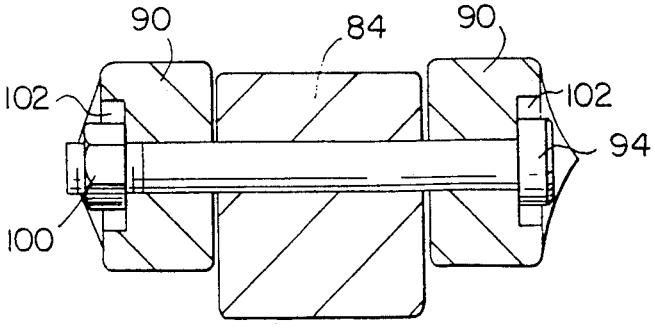
FIG. 11 is a partial longitudinal view of the tool of FIG. 9, taken along the lines 11—11 in FIG. 9.

Still another splitting tool 74 according to the present invention is illustrated in FIGS. 9 through 11. Tool 74, while embodying all of the features of the invention, bears a closer resemblance to a traditional ax. Tool 74 comprises a handle 76 and a splitting head 78. Handle 76 is contoured much like a traditional ax handle, and has a neck 80 at one end to which splitting head 78 is attached. Splitting head 78 comprises wedge means 82 and 84. Wedge means 82 comprises an eye 86 therethrough which receives neck 80 of handle 76. Handle 76 is secured to wedge means 82 by means of a serrated locking wedge 88, which is driven into neck 80 of handle 76 through eye 86, just as a conventional ax head is attached to a handle. Thus, in tool 74, rather than being rotatable with respect to the handle, wedge means 82 is fixed relative to the handle, just like a conventional ax head.

Wedge means 82 includes a pair of wedge fingers 90 spaced apart by a shank 92. Wedge means 82 may conveniently be cast of a suitably hard and durable material such as steel, or may be machined from a single block or fabricated of individual parts suitably joined together, such as by welding.

Wedge means 84 is received in the space between wedge fingers 90 on wedge means 82. Preferably, the width of wedge means is just slightly less than the gap between wedge fingers 90. As shown in FIG. 11, wedge means 84 is rotatably attached to wedge means 82 by means of a threaded bolt 94, which passes through bores 96 in wedge fingers 90 and an aligning bore 98 in wedge means 84. Bores 96 and 98 are all substantially coaxial. Bores 96 are preferably threaded to threadedly receive bolt 94. Bore 98 has an inner diameter preferably slightly larger than the diameter of bolt 94 and is not threaded, so that wedge means 84 may rotate freely about the bolt. Bolt 94 is secured in place by a locking nut 100. If desired, the outer faces of wedge fingers 90 may be provided with counterbores 102 around bores 96, in order to recess the head of bolt 94 and nut 100. Bolt 94 defines a pivot axis about which wedge means 84 may rotate relative to wedge means 82.

Wedge means 84 and wedge fingers 90 terminate in front edges 104 and 106, respectively, for striking and penetrating an object to be split. Thus, front edges 104 and 106 are tapered to a keen cutting edge, just like a conventional ax blade. Rearward of front edge 104, wedge means 84 widens to a lobe 106. As best seen in FIG. 10, most of the mass of wedge means 84 is located in lobe 106, behind the pivot axis defined by bolt 94. Hence, wedge means 84 will have a center of mass M″ located in lobe 106 and offset from the axis defined by bolt 94. This enables wedge means 84 to rotate freely about bolt 94 when tool 74 is swung at an object to be split.

As with the previously-described embodiments, splitting tool 74 is grasped by handle 76 and swung, just like an ax, at the object to be split. Also as with the previous embodiments, when the tool is swung toward the object, wedge means 84 will tend to pivot in a clockwise direction, so that front edges 104 and 106 will align along a common plane, giving tool 74 a substantially continuous cutting edge made up of front edges 104 and 106. Wedge means 82 and 84 may be provided with opposing flats 110 and 112, respectively, which act as stops to limit clockwise rotation of wedge means 84 with respect to wedge means 82 and ensure that edges 104 and 106 remain in alignment for striking. After splitting head 78 strikes the object, wedge means 84 will tend to rotate in the counterclockwise direction, and front edge 104 will tend to rotate past front edges 106 through their common plane. To limit counterclockwise rotation of wedge means 84, it may be provided with a pawl 114 which engages a corresponding stop surface 116 on wedge means 82. As wedge means 84 rotates after splitting head 78 strikes the object, it applies splitting forces F″ to the object, as shown by the horizontal arrows in FIG. 10. The splitting forces are generally, although not exactly, perpendicular to the common plane, so that substantially all of the energy imparted to tool 74 in striking the object goes into splitting it.

It should be noted that the splitting tool of the present invention does not require levers, springs, or contact between spreaders and the object in order to achieve rotation of the wedge means, and thus apply splitting forces to the object. Instead, the tool of the present invention achieves a high splitting efficiency by utilizing the natural movement of the tool and the application of basic principles of mechanics. Hence, it is not necessary that the tool of the present invention attain a minimum degree of penetration of the object being split, as do prior art splitters, in order to actuate the wedge fingers. This means that the tool of the present invention need not be swung very hard against an object in order to be effective, which, in turn, means that the tool of the present invention is less tiring to use. In addition, because the wedge means rotate freely with respect to the handle, pulling tool 10 away from the object will cause wedge fingers 20 of the wedge means 16 and 18 to rotate toward each other, making it virtually impossible for the tool to bind in the object, which is not the case with prior art splitting tools.

The present invention may be embodied in other specific forms without departing from the spirit or essential attributes thereof and, accordingly, reference should be made to the appended claims, rather than to the foregoing specification, as indicating the scope of the invention.

I claim:

1. A splitting tool comprising a splitting head mounted on handle means, the splitting head comprising at least two relatively rotatable wedge means, at least one of the wedge means being also freely rotatable with respect to the handle means, each wedge means having a front edge for striking and penetrating an object to be split, said freely rotatable wedge means having a lobe rearward of the front edge and a center of mass located in said lobe and offset from the axis of rotation of said freely rotatable wedge means for creating a force moment about said axis, said force moment being in a first rotational sense tending to align the front edges of each wedge along a common plane when the splitting head is impelled toward the object and being in a second and opposite rotational sense tending to separate the front edges of each wedge when the splitting head strikes the object, thereby applying splitting forces to the object in directions generally perpendicular to said common plane.

2. A splitting tool, comprising a splitting head and means for impelling the splitting head toward an object to be split, the splitting head comprising first and second wedge means, the first wedge means being fixed relative to the impelling means and the second wedge means being rotatable relative to the first wedge means about an axis of rotation, each wedge means having a front edge for striking and penetrating the object to be split, the second wedge means having a center of mass offset from the axis of rotation for creating a force moment about the axis acting on the second wedge means when the splitting head is accelerated, the force moment tending to align the front edges of the first and second wedge means along a common plane when the splitting head is accelerated in a first and second wedge means when the splitting head is accelerated in the opposite direction.

3. A splitting tool according to claim 2, wherein the impelling means comprises a handle.

4. A splitting tool according to claim 3, wherein the handle is generally elongated.

5. A splitting tool according to claim 2, wherein the first wedge means comprises a pair of spaced-apart wedge fingers each having a front edge, the front edges of the first wedge means being in substantially the same plane, said plane defining the common plane, and wherein the second wedge means is located for rotation in the space between the wedge fingers of the first means.

6. A splitting tool, comprising an ax-like splitting head mounted on an elongated handle for swinging the splitting head at an object to be split, the splitting head comprising a fixed cutting edge for striking and penetrating the object to be split and a splitting wedge rotatably mounted thereon for rotation about an axis and having a cutting edge alignable with the fixed cutting edge, the splitting wedge having means integral therewith for rotating the wedge to a position in which the cutting edge thereof is substantially in alignment with the fixed cutting edge when the splitting head is swung at the object and for rotating the wedge to a position in which the cutting edge thereof is out of alignment with the fixed cutting edge when the splitting head strikes the object.

7. A splitting tool according to claim 6, wherein the means for rotating the splitting wedge comprises an integral lobe having a center of mass spaced apart from the axis of rotation of the splitting wedge.

8. A splitting tool according to claim 6, wherein the splitting head includes a gap in the cutting edge thereof and the splitting wedge is mounted for rotation in the gap.

* * * * *